US006427510B2

(12) United States Patent
Schlafhauser et al.

(10) Patent No.: US 6,427,510 B2
(45) Date of Patent: Aug. 6, 2002

(54) BENDING AND HEMMING METHOD AND APPARATUS

(75) Inventors: Joseph K. Schlafhauser, Troy, MI (US); Philip V. Wiens, LaSalle (CA)

(73) Assignee: Unova IP Corp., Woodland Hills, CA (US)

( * ) Notice: Subject to any disclaimer, the term of this patent is extended or adjusted under 35 U.S.C. 154(b) by 0 days.

(21) Appl. No.: 09/731,123

(22) Filed: Dec. 6, 2000

Related U.S. Application Data

(60) Provisional application No. 60/188,438, filed on Mar. 10, 2000.

(51) Int. Cl.[7] ..... B21D 5/04; B21D 39/02
(52) U.S. Cl. ..... 72/306; 29/243.58
(58) Field of Search ..... 72/306, 323, 322, 72/312; 29/243.58

(56) References Cited

U.S. PATENT DOCUMENTS

| | | | | |
|---|---|---|---|---|
| 3,130,770 A | | 4/1964 | Tribe | 153/12 |
| 4,928,388 A | | 5/1990 | Dacey, Jr. | 29/798 |
| 5,005,398 A | * | 4/1991 | Evans | 72/450 |

FOREIGN PATENT DOCUMENTS

| | | | |
|---|---|---|---|
| JP | 3-221214 | * | 9/1991 |
| JP | 3-221215 | * | 9/1991 |
| JP | 4-59140 | * | 2/1992 |
| JP | 7-164064 | * | 6/1995 |
| JP | 9-38733 | * | 2/1997 |
| JP | 2001-71068 | * | 3/2001 |

* cited by examiner

*Primary Examiner*—Daniel C. Crane
(74) *Attorney, Agent, or Firm*—Reising, Ethington, Barnes, Kisselle, Learman & McCulloch, P.C.

(57) ABSTRACT

A bending and hemming apparatus configured to both bend and hem a sheet metal panel to form a body closure member at a single station. The apparatus includes a hemming machine movable between a retracted position spaced from a bending machine and advanced positions adjacent the bending machine to assist in the bending operation and to hem the body panel into a finished product. The apparatus also includes an anvil assembly pivotably supported on the hemming machine. The anvil assembly is movable between a lowered position where it engages the workpiece when the hemming machine is advanced to a bending position adjacent the bending machine. In the lowered position, the anvil assembly provides a fulcrum around which the workpiece is bent. The anvil assembly is pivotable to a raised position to allow the hemming machine to be advanced to a hemming position adjacent the bending machine from which the hemming machine can engage the bent workpiece to hem the workpiece.

10 Claims, 12 Drawing Sheets

Lamb Tailgate Hemmer/Bender Combo Station
Sequence of Operations

| Action | Duration (sec) | Time | | | | | | | | | | | | | | | | | | | | | | | | |
|---|---|---|---|---|---|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| Robot Load Part | 0.5 | | | | | | | | | | | | | | | | | | | | | | | | | |
| Actuate Suction Cups | 0.5 | | | | | | | | | | | | | | | | | | | | | | | | | |
| Pivot Hold Down Anvil Down | 2.0 | | | | | | | | | | | | | | | | | | | | | | | | | |
| Extend Gate Slide To Clamp Part | 1.0 | | | | | | | | | | | | | | | | | | | | | | | | | |
| Advance Rotate Bender 148 Deg | 3.0 | | | | | | | | | | | | | | | | | | | | | | | | | |
| Retract Gate Slide | 3.0 | | | | | | | | | | | | | | | | | | | | | | | | | |
| Pivot Hold Down Anvil Up | 2.0 | | | | | | | | | | | | | | | | | | | | | | | | | |
| Extend Gate Slide To Hem Position | 3.0 | | | | | | | | | | | | | | | | | | | | | | | | | |
| Advance Rotate Bender 12 Deg Complete | 1.0 | | | | | | | | | | | | | | | | | | | | | | | | | |
| Extend Pre-Hem Steels | 1.5 | | | | | | | | | | | | | | | | | | | | | | | | | |
| Extend Corner Units | 1.5 | | | | | | | | | | | | | | | | | | | | | | | | | |
| Retract Corner Units | 1.5 | | | | | | | | | | | | | | | | | | | | | | | | | |
| Extend Final-Hem Steels | 1.5 | | | | | | | | | | | | | | | | | | | | | | | | | |
| Retract Final Hem & Pre-Hem Steels | 3.0 | | | | | | | | | | | | | | | | | | | | | | | | | |
| Retract Rotate Bender | 3.0 | | | | | | | | | | | | | | | | | | | | | | | | | |
| Retract Hem Gate Slide | 3.0 | Transfer Part Time | | | | | | | | | | | | | | | | | | | | | | | | |

FIG. 18

BENDING AND HEMMING METHOD AND APPARATUS

REFERENCE TO PROVISIONAL PATENT APPLICATION

This application claims the benefit of provisional patent application Ser. No. 60/188,438 filed Mar. 10, 2000.

FIELD OF THE INVENTION

This invention relates to an apparatus for bending and hemming a metal panel into an automotive body closure member such as a tailgate.

BACKGROUND OF THE INVENTION

An automotive body panel closure member such as a tailgate generally comprises both an inner panel and an outer panel that may be formed from a single sheet of material such as sheet metal. To form such a body panel, the sheet must be folded upon itself, i.e., "doubled-over" and the mating edges joined to provide a finished and structurally sound component for use on a vehicle. One well-known process for joining the edges of such a panel is known in the art as hemming and is accomplished using a hemming machine that folds the edge of one panel over the edge of the other panel to mechanically lock the panel edges together.

SUMMARY OF THE INVENTION

The invention is a bending and hemming apparatus comprising a bending machine configured to support a metal panel workpiece at a bending station and to bend the metal panel workpiece until the metal panel workpiece is doubled-over such that opposite mating edges of the panel are brought together and generally aligned in preparation for hemming. The apparatus includes a hemming machine configured to hem at least one mating edge of the metal panel workpiece. The hemming machine is configured to hem at least one mating edge of a metal panel workpiece while the workpiece is still supported on the bending machine at the bending station to obviate the need to transport the workpiece from the bending station to a separate hemming station following bending.

According to another aspect of the invention, a method is provided for both bending and hemming a metal panel workpiece. The method includes loading a metal panel workpiece onto a bending machine and moving an anvil assembly into a position to act as a fulcrum for subsequent bending of the workpiece. The workpiece is then bent a predetermined number of degrees around an anvil tool portion of the anvil assembly by rotating a movable die element of the bending machine the predetermined number of degrees until the metal panel workpiece is doubled-over such that mating edges of the panel are brought together and generally aligned. A finished part is then formed from the workpiece by actuating the hemming machine to hem at least a portion of a mating edge of the workpiece. The bending machine and hemming machine are then actuated to release the finally hemmed part.

Objects, features and advantages of this invention include the ability to bend and hem the edge of a sheet metal workpiece at a single work station, and to pre-hem the edge of a sheet metal workpiece at the same work station where initial bending and hemming occur.

Description of the Drawings

These and other objects, features and advantages of this invention will be apparent from the following detailed description of the preferred embodiment and best mode, appended claims, and accompanying drawings in which:

FIG. 18 is a flow chart depicting the sequence of bending and hemming operations for the apparatus of FIG. 1.

DETAILED DESCRIPTION

Figure 1:
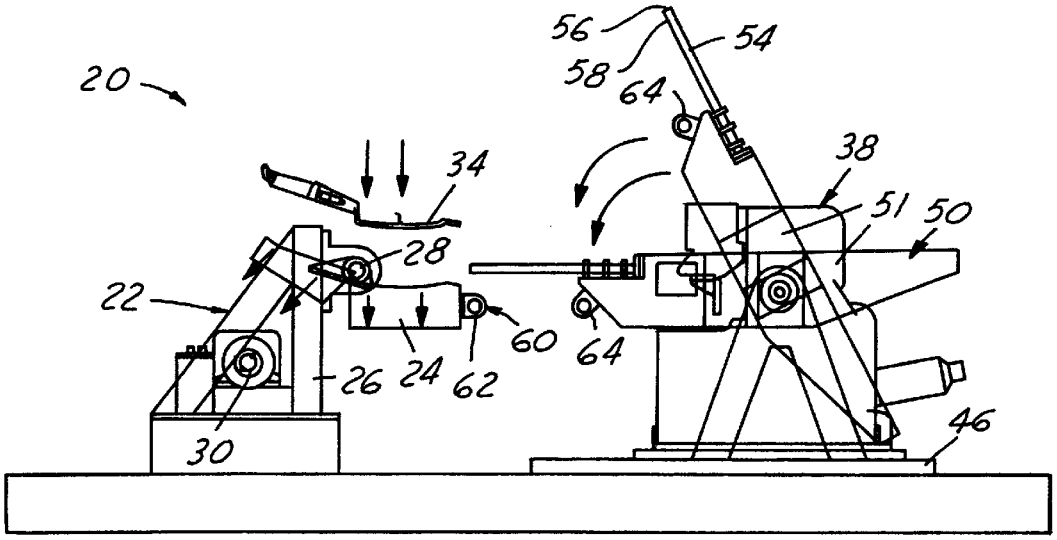
FIG. 1 is a diagrammatic front view of a bending and hemming apparatus constructed according to the invention showing a bottom end hemming machine of the apparatus in a retracted position, an anvil assembly of the apparatus in a lowered position, the anvil assembly shown in a raised position in phantom, and with two side edge hemming machines and corner units of the apparatus omitted for clarity.

FIGS. 1–17 illustrate a combination body panel bender and hemmer apparatus 20 constructed according to the invention. The apparatus 20 has a turnover station or bending machine 22 with a fixed lower die 24 supported on a bending machine frame 26 and an upper die 28 pivotably mounted adjacent the fixed lower die 24 on the bending machine frame 26. The bending machine 22 also includes a bender drive mechanism 30 operatively connected to the upper die 28 and configured to rotate the upper die 28 between an open position, a partially closed position and a fully closed position. The bending machine 22 also includes a plurality of suction cups 32 or outlets disposed in the upper and lower die portions 28, 24 and configured to secure a metal panel workpiece 34 in position for bending on the die portions 24, 28. The bending machine 22 also includes a vacuum source (not shown) which may be of known construction in fluid communication with each suction cup of the plurality of suction cups 32.

Figure 7:
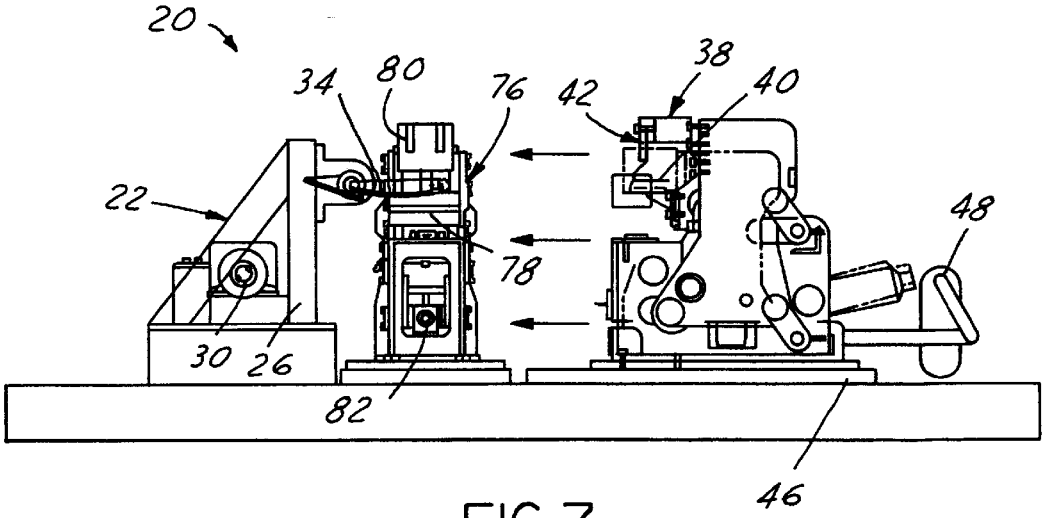
FIG. 7 is a diagrammatic front view of the apparatus of FIG. 1 showing the position of one of the side hemming machines relative to the bending machine, showing the bottom end hemming machine being advanced from the retracted position by a harmonic drive, and with the corner units omitted for clarity.
Figure 8:
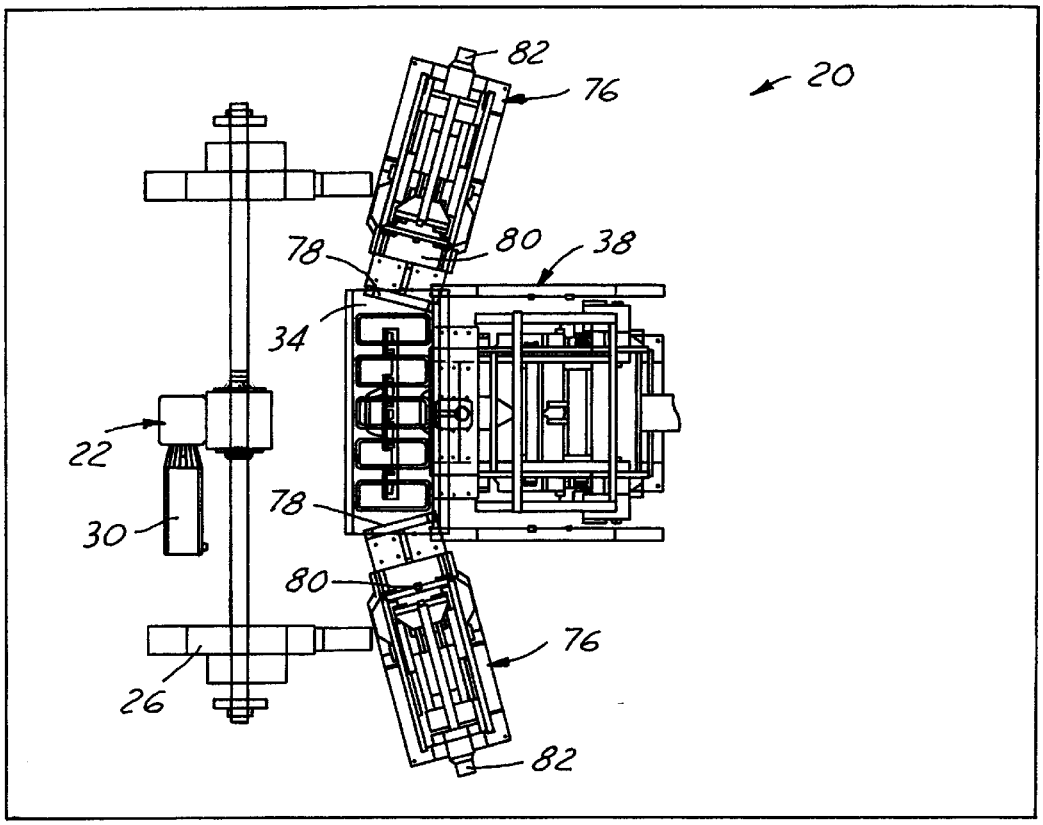
FIG. 8 is a diagrammatic top view of the apparatus of FIG. 1 showing the bottom end hemming machine advanced to the bending position, showing the relative position of the bending machine and the side hemming machines, and with the corner units removed for clarity.
Figure 9:
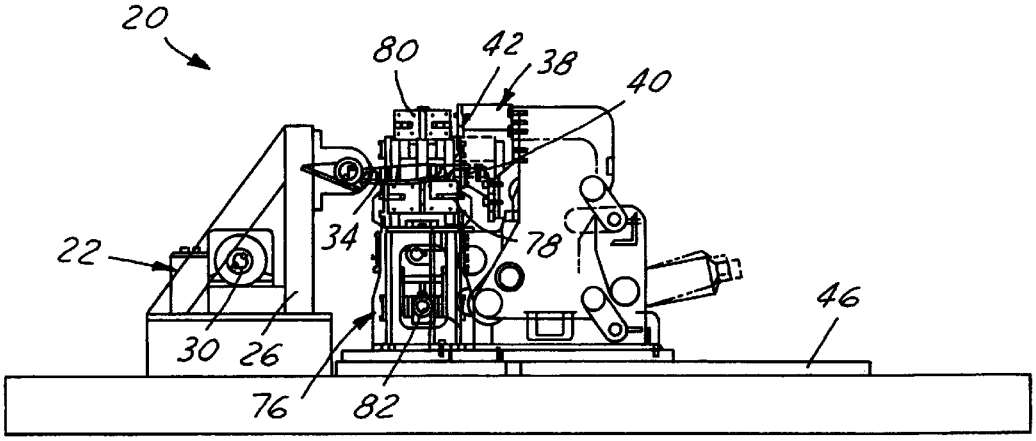
FIG. 9 is a diagrammatic front view of the apparatus of FIG. 8 with one of the side edge hemming machines and the corner units removed for clarity.
Figure 10:
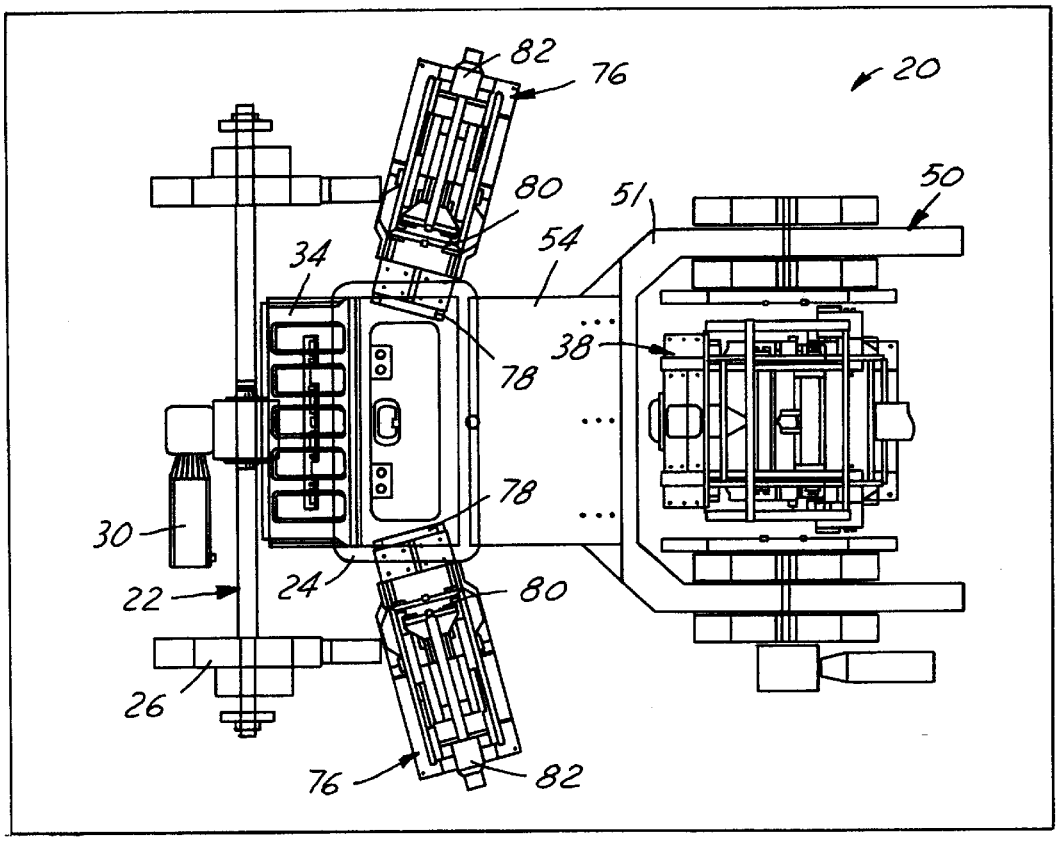
FIG. 10 is a diagrammatic top view of the apparatus as shown in FIG. 6 with the anvil assembly in the lowered position and corner units removed for clarity.
Figure 16:
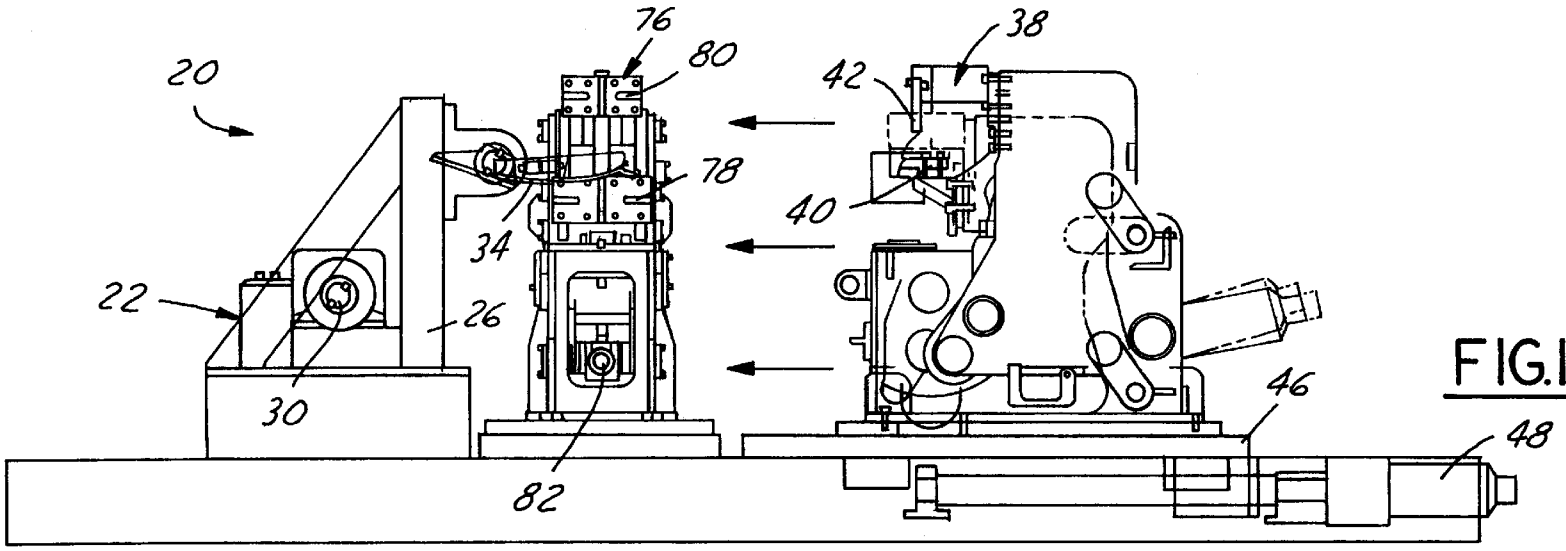
FIG. 16 is a diagrammatic front view of the apparatus of FIG. 1 as also shown in FIG. 7 but including the ball screw drive rather than a harmonic drive operatively connected to the bottom end hemming machine.
Figure 15:
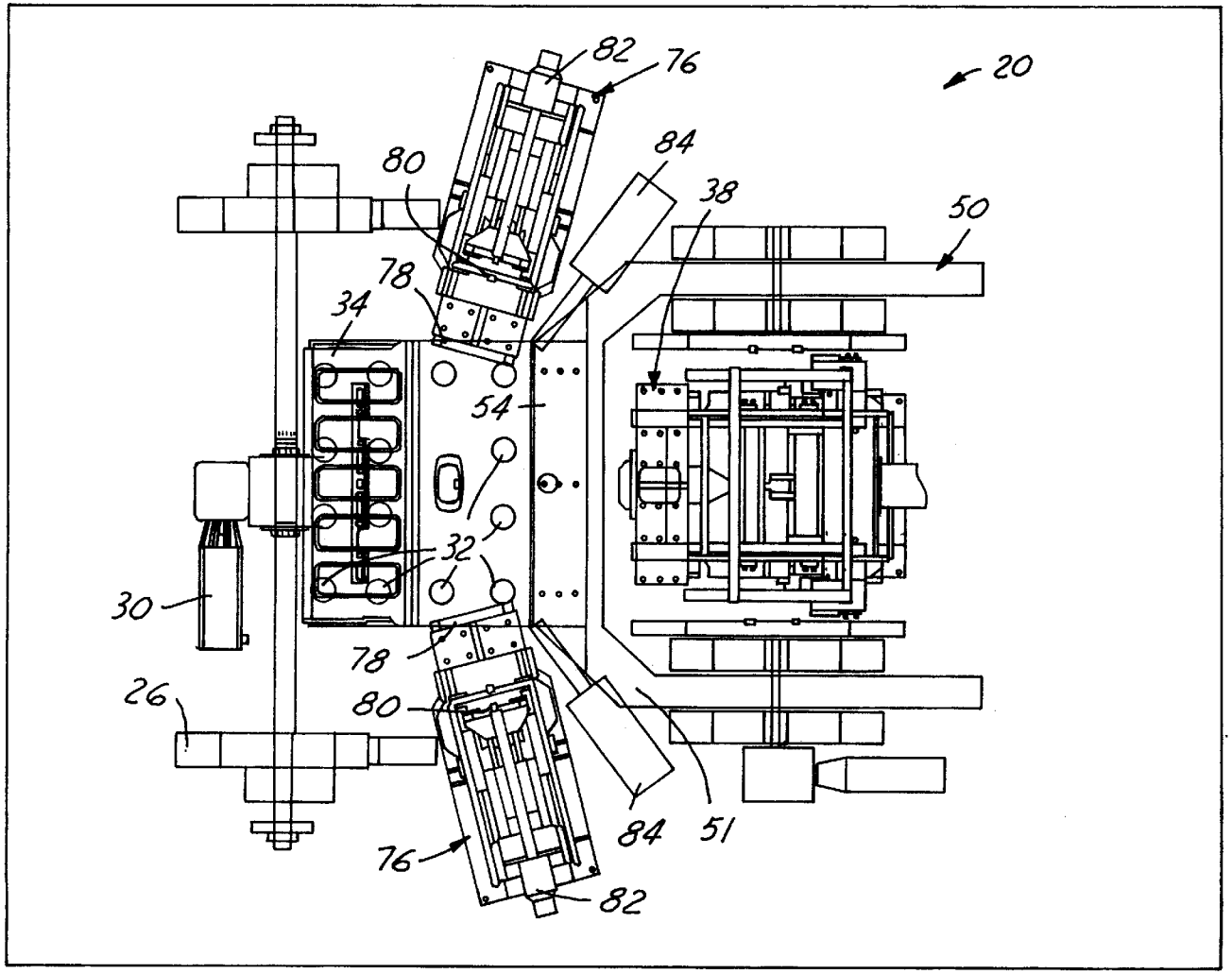
FIG. 15 is a diagrammatic top view of the apparatus of FIG. 14 as also shown in FIG. 3.
Figure 17:
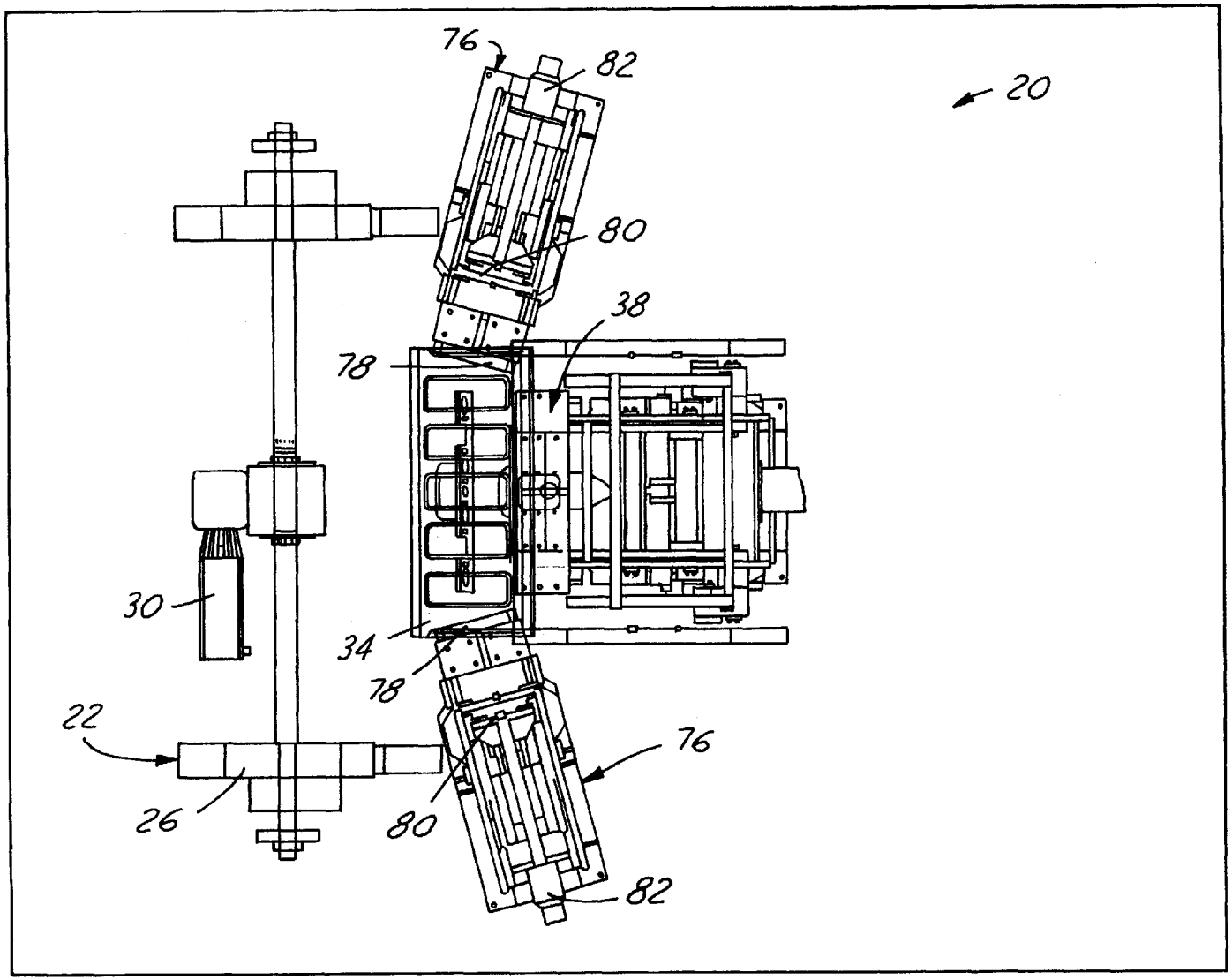
FIG. 17 is a diagrammatic top view of the apparatus of FIG. 1 as also shown in FIG. 8 with the corner units removed for clarity.

The apparatus 20 also has a lower end hemming machine 38 configured to hem an edge of the workpiece 34 that will become a lower end of a finished body panel following the bending and hemming operations. As shown in FIGS. 7, 9 and 16 the lower end hemming machine 38 includes a pre-hem steel 40 and a final hem steel 42 that are individually extendable and retractable by a hem steel drive mechanism 44 as is well known in the art. The lower end hemming machine 38 is supported on a linear slide 46 for reciprocal movement between a retracted position remote from the bending machine 22 and advanced bending and hemming positions adjacent the bending machine 22. The apparatus 20 also includes a hemming machine drive 48 operatively connected to the lower end hemming machine 38 and configured to move the lower end hemming machine 38 translationally on the linear slide 46 between the advanced and retracted positions. The hemming machine drive 48 may be a harmonic drive as shown in FIG. 7, a ball screw drive as shown in FIG. 16, or an air cylinder drive as shown in FIG. 19.

Figure 11:
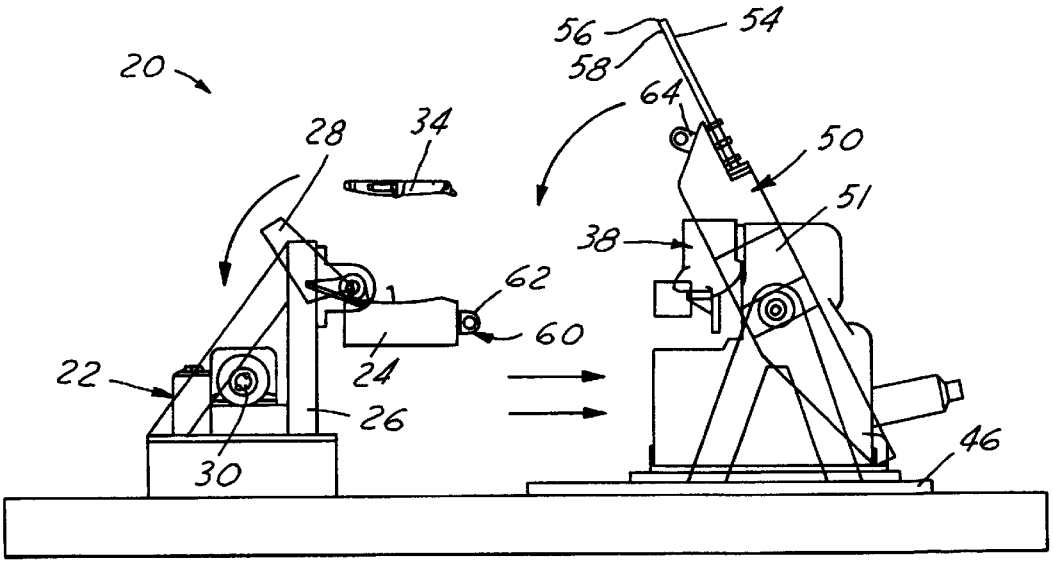
FIG. 11 is a diagrammatic front view of apparatus of FIG. 1 showing movable die portion of the bending machine in the opened position for removal of the part, and with the side edge hemming machines and corner units omitted for clarity.
Figure 12:
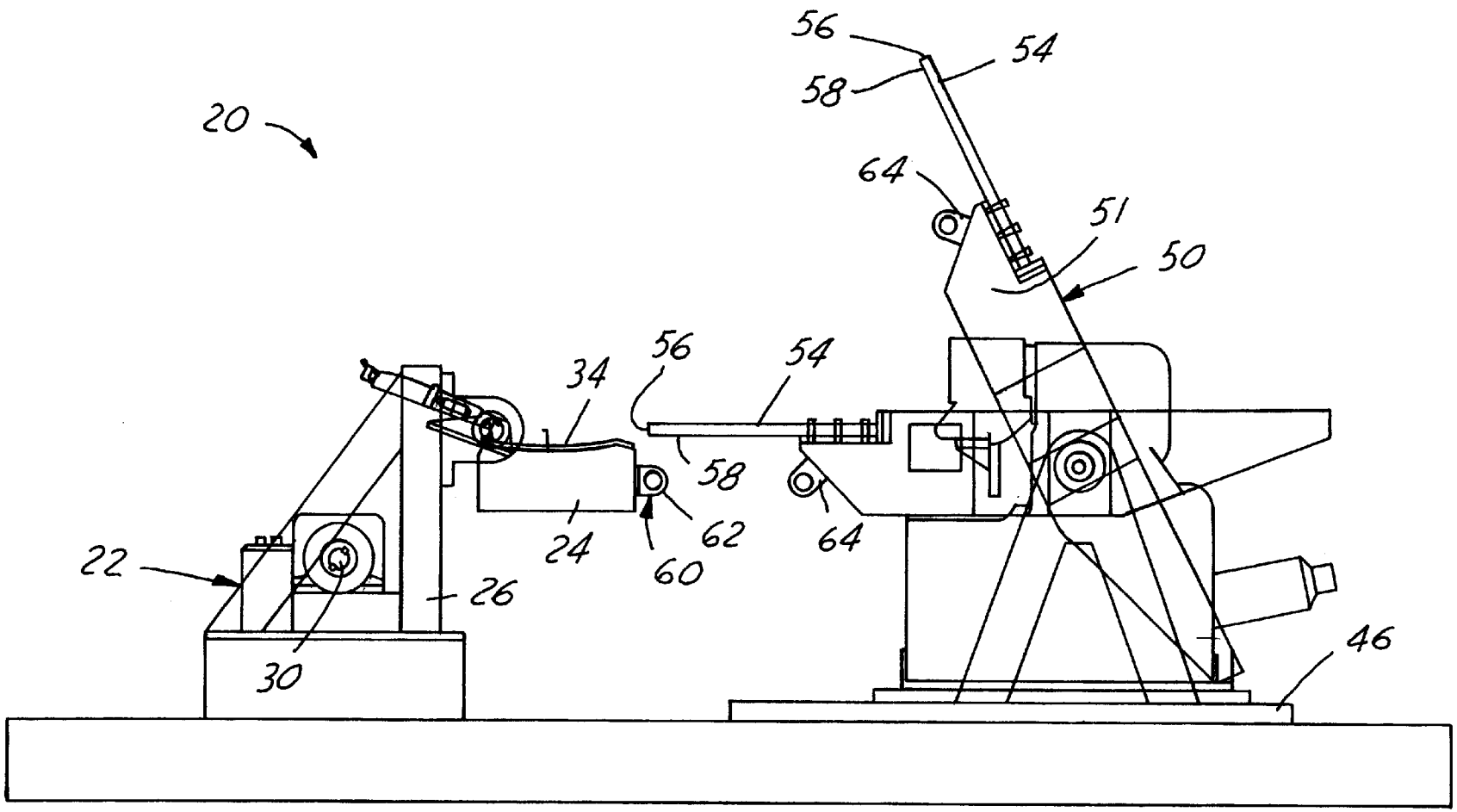
FIG. 12 is a diagrammatic front view of the apparatus of FIG. 1 with the workpiece, side edge hemming machines and corner units omitted for clarity.
Figure 13:
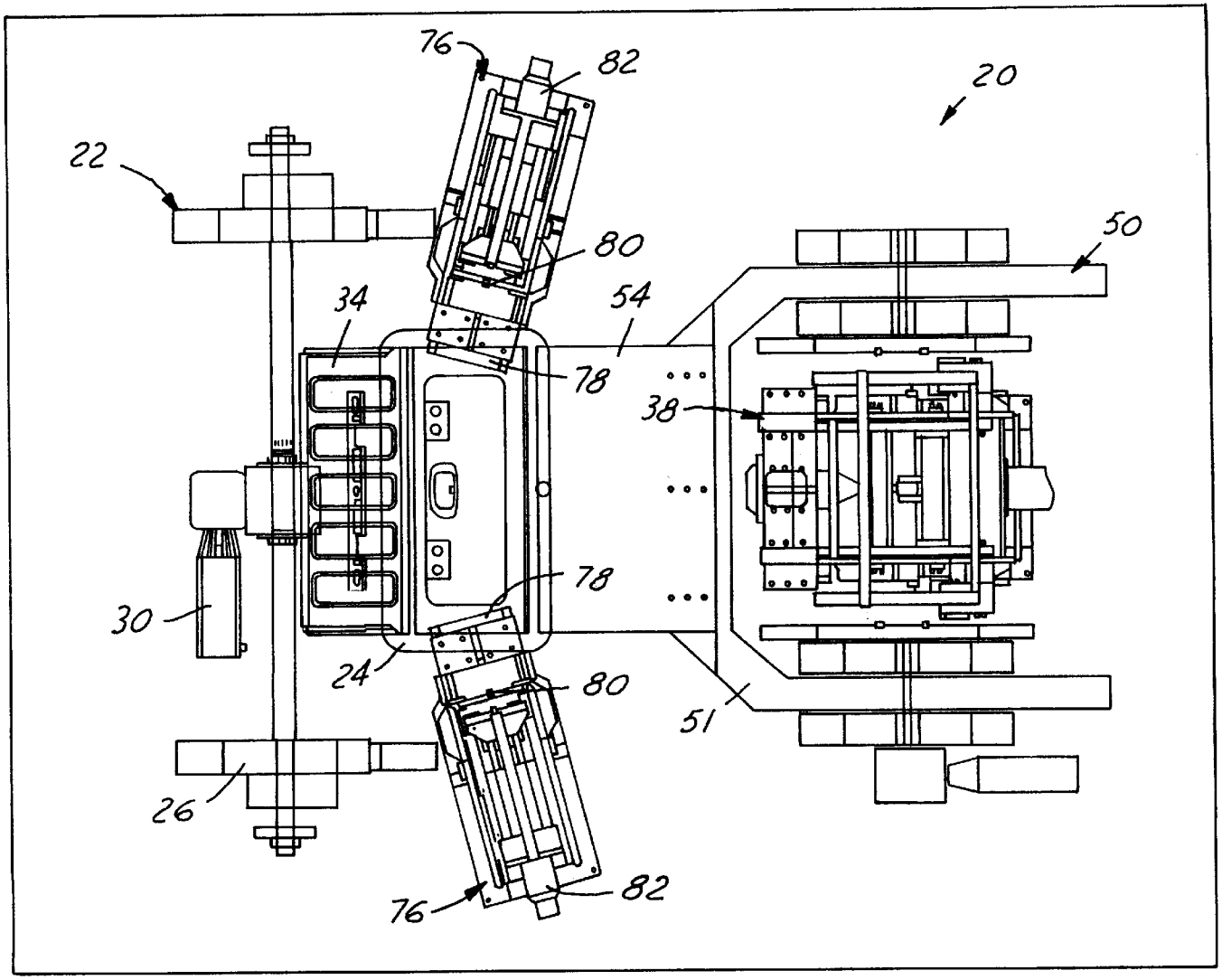
FIG. 13 is a diagrammatic top view of the apparatus of FIG. 12 as also shown in FIG. 10 with the corner units omitted for clarity.
Figure 14:
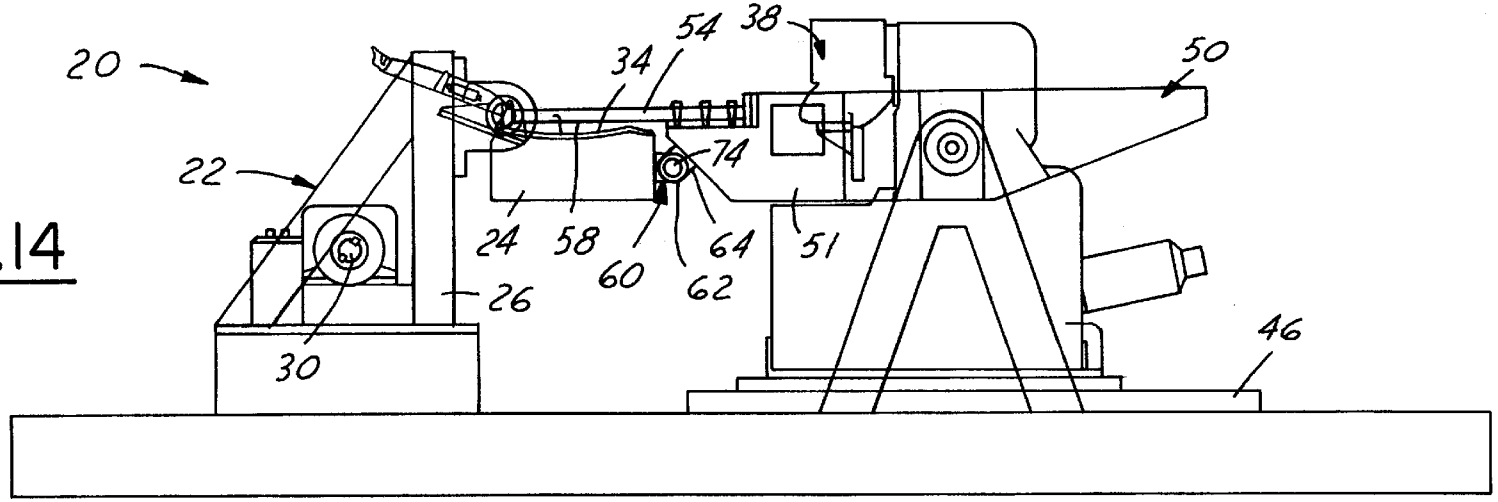
FIG. 14 is a diagrammatic front view of the apparatus as also shown in FIG. 2 with the side edge hemming machines and corner units omitted for clarity.

The apparatus 20 also has a hold-down anvil assembly 50 that is pivotably supported on the lower end hemming machine 38 for pivotal movement between a raised position best shown in FIG. 11 and a lowered position best shown in FIGS. 2, 4, 5 and 14. An anvil assembly drive 52 is operatively connected to the anvil assembly 50 to move the anvil assembly 50 between the raised and lowered positions. The anvil assembly drive 52 may be either an air cylinder, an electric motor or any other suitable drive mechanism known in the art. An anvil tool 54 of the anvil assembly 50 is removably attached to an arm portion 51 of the anvil assembly 50 that is pivotally supported on the lower end hemming machine 38. The anvil tool 54 is configured to act as a fulcrum to control the bending of the panel. The anvil tool 54 includes a leading edge 56 and an adjacent bottom surface 58. The leading edge 56 of the anvil tool 54 acts as the fulcrum around which the panel is bent and the adjacent bottom surface 58 holds the workpiece down against the lower die 24 during the bending operation. The anvil tool 54 is an interchangeable part and can be exchanged for anvil tools of other configurations to accommodate body panels of varying configurations.

The apparatus 20 has a vertical positioning mechanism 60 comprising apertured lower die tabs 62 fixed to the lower die part 24 of the bending machine 22 and apertured anvil arm tabs 64 fixed to the arm 51 of the anvil assembly 50. Apertures formed in the lower die tabs 62 are positioned to coaxially align with apertures formed in the anvil arm tabs 64 when the anvil assembly 50 is in the lowered position and the lower end hemming machine 38 is in the bending position. A tapered pin 74 of the vertical positioning mechanism 60 is automatically driven axially through the aligned apertures when the lower end hemming machine 38 is in the bending position to lock the anvil assembly 50 to the lower die 24 of the bending machine 22 as the bending machine 22 is bending the workpiece. The tapered pin 70 is automatically withdrawn before the lower end hemming machine 38 is withdrawn along the linear slide 46.

Figure 19:
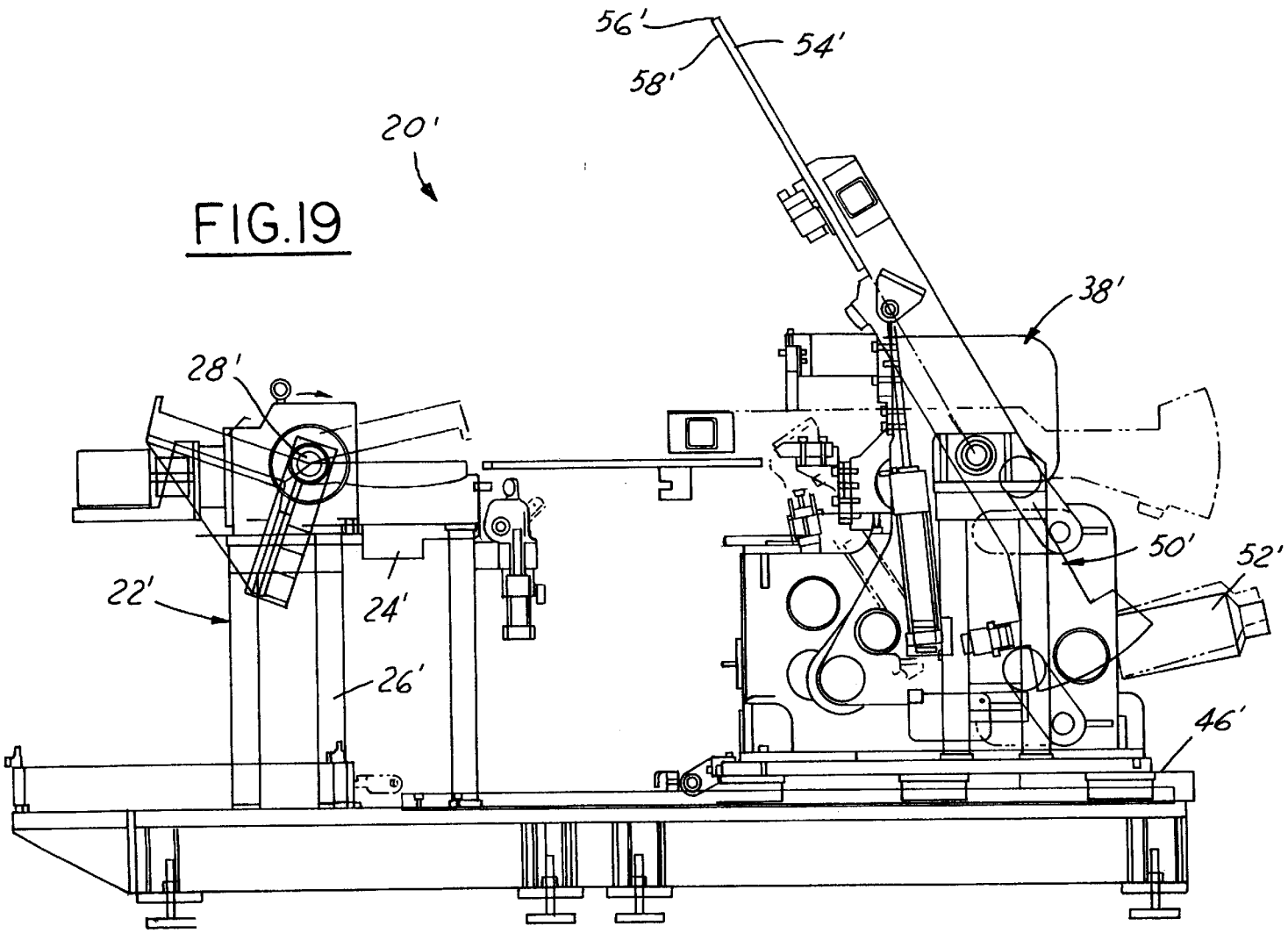
FIG. 19 is a diagrammatic front view of an alternative bending and hemming apparatus constructed according to the invention.

In other embodiments of the combination body panel bender and hemmer apparatus such as the one shown at 20' in FIG. 19, the vertical positioning mechanism may include a key 66 and keyway 68 arrangement instead of the pin lock mechanism described above. As shown in FIG. 19, the key 66 is supported on the lower die part 24 of the bending machine 22 and the keyway 68 is supported under the arm 51 of the anvil assembly 50. When the lower end hemming machine 38 is advanced to the bending position, the key 66 is received into a complimentary shaped notch 69 in the keyway 68 to prevent any relative vertical motion between the anvil tool 54 and the bending machine 22. In FIG. 19, reference numerals with the designation prime (') indicate alternative configurations of elements that appear in FIGS. 1–17.

Side hemming machines 76 are positioned on either side of the lower die 24 of the bending machine 22 in respective positions to hem respective side edges of the workpiece 34 that will become side seams of the finished body panel. Each side hemming machine 76 includes a pre-hem steel 78 and a final hem steel 80 that are individually movable to a position engaging respective side edges of the workpiece 34 to hem those edges. Each side hemming machine 76 also includes a hem steel drive unit 82 that is operatively connected to the pre-hem and final hem steels 78, 80 of each side hemming machine 76, respectively, to individually advance and retract the steels 78, 80 for pre-hem and final hem operations.

Corner hemming machines 84 may be positioned adjacent the side hemming machines 76 in respective positions to initiate hemming operations at corners of the body panel as is known in the art.

Figure 3:
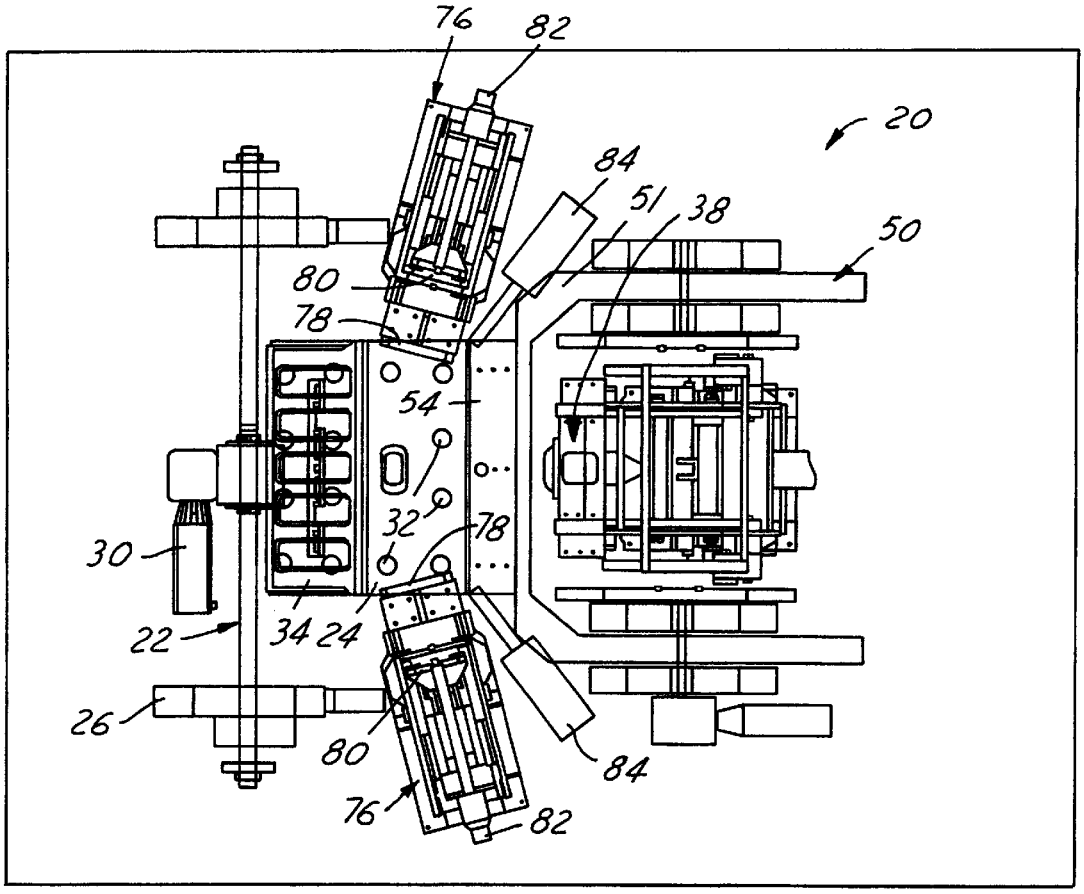
FIG. 3 is a diagrammatic top view of the apparatus of FIG. 2 and also showing the side and corner hemming units omitted from FIGS. 1 and 2.
Figure 2:
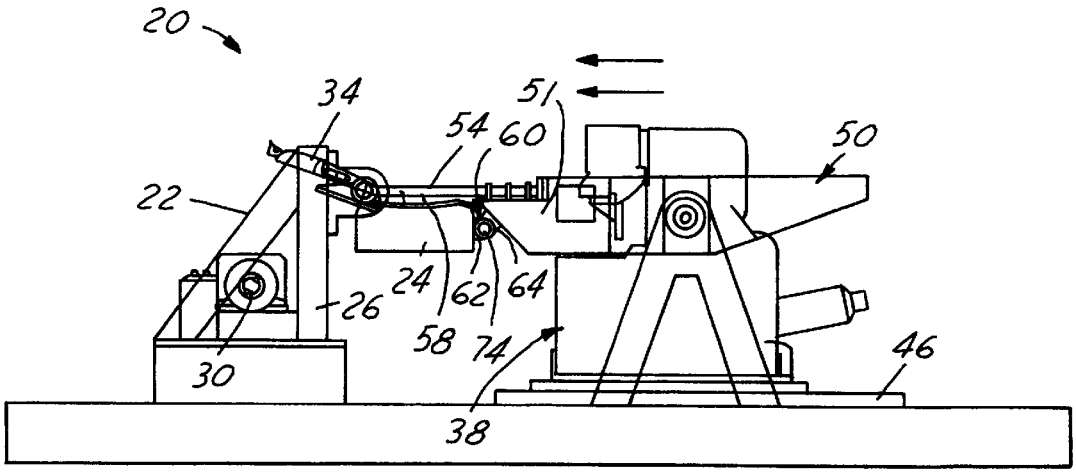
FIG. 2 is a diagrammatic front view of the apparatus of FIG. 1 showing the anvil assembly in a lowered position, the hemming machine advanced to a bending position, a movable die portion of the bending machine in an open position and with the side edge hemming machines and corner units omitted for clarity.

In practice, a vehicle closure member such as tailgate can be formed according to the invention by loading a pre-stamped metal panel workpiece 34 onto the upper and lower die portions 24, 28 of the bending machine 22 as shown in FIG. 1. The vacuum source is then actuated to provide suction at the suction cups 32 to hold the workpiece 34 securely in a position for bending and hemming as is also shown in FIG. 1. The workpiece 34 may be loaded by a robot or any other means known in the art. The anvil assembly drive 52 is then actuated to rotate the anvil assembly 50 from the raised position to the lowered position. The hemming machine drive 48 is then actuated to advance the lower end hemming machine 38 and the anvil assembly 50 to a position where the anvil tool 54 engages the panel, i.e., the bending position as shown in FIGS. 2 and 3. Once the lower end hemming machine 38 has advanced to the bending position, the pin lock mechanism 60 is actuated to drive the tapered pin 74 through the coaxially aligned apertures, 70 of the lower die tabs 62 and the anvil arm tabs 64.

Figure 4:
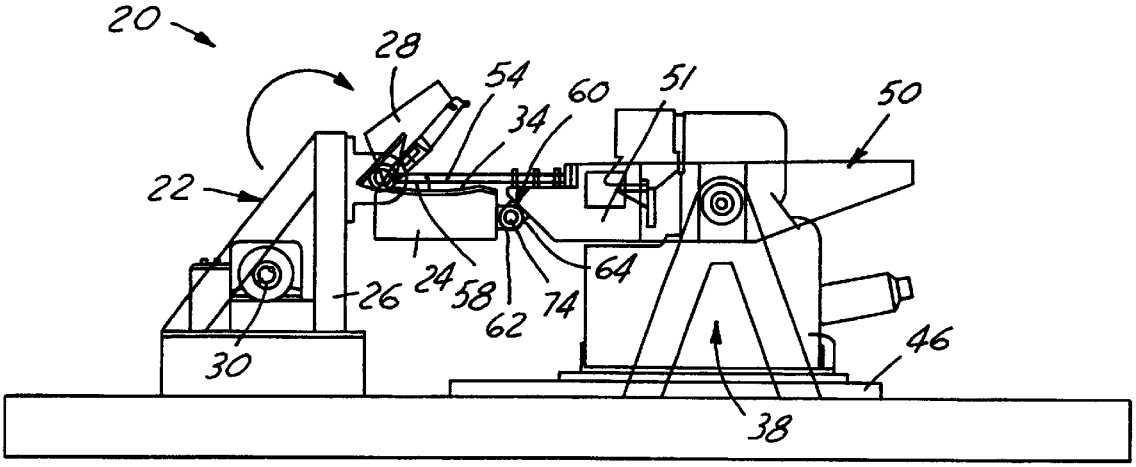
FIG. 4 is a diagrammatic front view of the apparatus of FIG. 1 with the movable die portion of the bending machine in a partially closed position, the anvil assembly in the lowered position, the bottom end hemming machine advanced to a hemming position and with the side edge hemming machines and corner units omitted for clarity.
Figure 5:
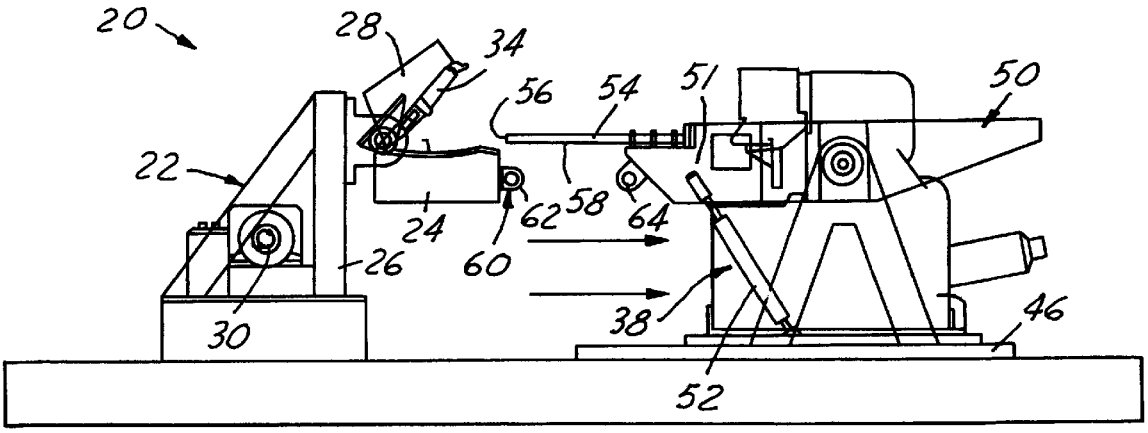
FIG. 5 is a diagrammatic front view of the apparatus of FIG. 1 showing the bottom end hemming machine and anvil assembly in the retracted position and with the side edge hemming machines and corner units omitted for clarity.

The bender drive mechanism 30 of the bending machine 22 is then actuated to pivot the upper die portion 28 to the partially closed position as shown in FIG. 4 which bends the panel workpiece 34 approximately 148° to the partially closed position. During the bending operation, the leading edge 56 of the anvil tool 54 acts as a fulcrum against which the panel workpiece 34 is bent. After the apparatus 20 completes the bending operation, the pin lock mechanism 60 is actuated to remove the tapered pin 74 from the lower die tabs 62 and the anvil arm tabs 64. The hemming machine drive 48 is then actuated to retract the lower end hemming machine 38 and anvil assembly 50 along the linear slide 46.

Figure 6:
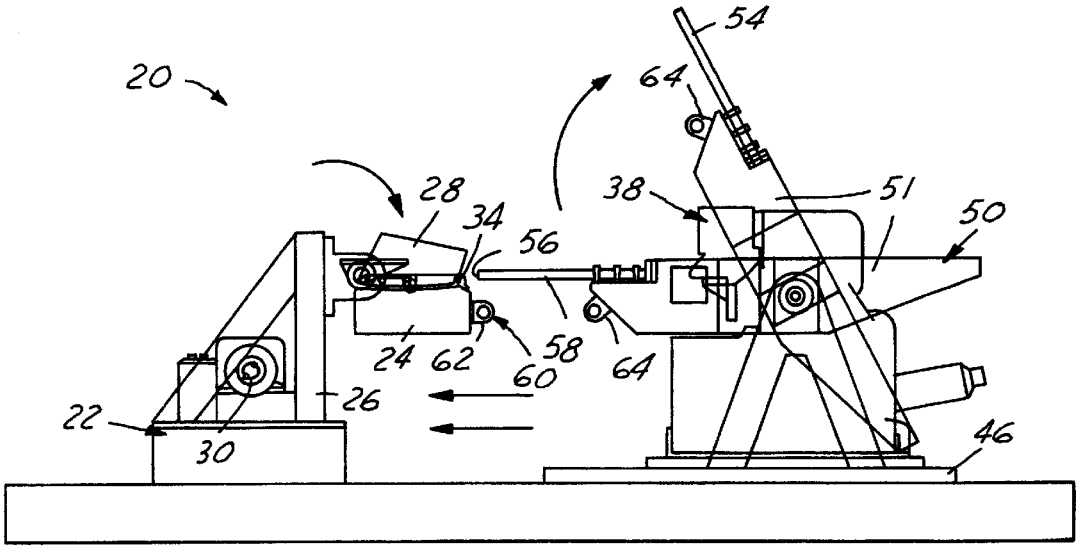
FIG. 6 is a diagrammatic front view of the apparatus of FIG. 1 showing the anvil assembly in the raised position, the movable die post portion of the bending machine in a fully closed position, and with the side edge hemming machines and corner units omitted for clarity.

To begin the hemming operation, the anvil assembly drive 52 is actuated to rotate the anvil assembly 50 to the raised position as shown in FIG. 6. The hemming machine drive 48 is then actuated to advance the lower end hemming machine 38 to the hemming position shown in FIGS. 8 and 9. The bender drive mechanism 30 is then actuated to pivot the upper die portion 28 a final 12° to the closed position as shown in FIG. 6. The pre-hem steels of the lower end hemming machine 38 and side hemming machines 76 are then extended to pre-hem the panel workpiece 34. If present, the corner hemming machines 84 may be then extended to initially hem respective corners of the panel workpiece 34. The corner hemming machines 84 may then be retracted from engagement with the panel workpiece 34 and the final hem steels of the lower end and side hemming machines 38, 76 are extended to accomplish a final hem of the side and bottom end edges of the panel workpiece 34. The final hem steels are then retracted from their respective positions in engagement with the panel workpiece 34.

Following the completion of the hemming operation, the bender drive mechanism 30 is actuated to pivot the upper die 28 portion away from the lower die 24 portion to the fully open position. The hemming drive is actuated to retract the lower end hemming machine 38 along the linear slide 46. The hemmed body panel is then removed from the bending machine 22.

This description is intended to illustrate certain embodiments of the invention rather than to limit the invention. Therefore, it uses descriptive rather than limiting words. Obviously, it's possible to modify this invention from what the description teaches and one may practice the invention other than as described.

What is claimed is:

1. A bending and hemming apparatus comprising:

a bending machine configured to support a metal panel workpiece at a bending station and to bend the metal panel workpiece until the metal panel workpiece is doubled-over such that opposite mating edges of the panel are brought together and generally aligned in preparation for hemming;

a hemming machine configured to hem at least one mating edge of the metal panel workpiece; and the hemming machine being configured to hem at least one mating edge of a metal panel workpiece while the workpiece is still supported on the bending machine at the bending station to obviate the need to transport the workpiece from the bending station to a separate hemming station following bending.

2. The bending and hemming apparatus of claim 1 in which:

the hemming machine is movable between a retracted position spaced from the bending machine and advanced bending and hemming positions adjacent the bending machine; and the apparatus includes an anvil assembly pivotally supported on the hemming machine for motion between a lowered position and a raised position and configured to engage and provide a fulcrum for bending the workpiece until the workpiece is doubled-over such that opposite mating edges of the panel are brought together and generally aligned when the hemming machine is in the bending position and the anvil assembly is in the lowered position, the anvil assembly being movable to the raised position to prevent the anvil assembly from interfering with the hemming of the mating edges of the bent workpiece when the hemming machine is advanced to the hemming position.

3. The bending and hemming apparatus of claim 2 in which the bending machine includes:

a fixed lower die part;

an upper die part mounted for pivotal motion relative to the upper die part;

a workpiece retainer mechanism that secures a metal panel workpiece on the upper and lower die parts; and a bender drive mechanism operatively connected to the upper die part to rotate the upper die part relative to fixed lower die part to bend a workpiece secured on the die parts.

4. The bending and hemming apparatus of claim 1 in which the hemming machine is further configured to hem together mating edges of a doubled-over metal panel workpiece while the workpiece is still supported on the bending machine at the bending station.

5. A method of both bending and hemming a metal panel workpiece; the method including the steps of:

loading a metal panel workpiece onto a bending machine;

moving an anvil assembly into a position to act as a fulcrum for subsequent bending of the workpiece;

bending the workpiece a predetermined number of degrees around an anvil tool portion of the anvil assembly by rotating a movable die element of the bending machine the predetermined number of degrees until the metal panel workpiece is doubled-over such that mating edges of the panel are brought together and generally aligned;

forming a finished part from the workpiece by actuating the hemming machine to hem at least a portion of a mating edge of the workpiece; and actuating the bending machine and hemming machine to release the finished part.

6. The method of claim 5 in which the step of loading a metal panel workpiece onto a bending machine includes actuating a workpiece retainer mechanism of the bending machine to hold the metal panel in position on the bending machine.

7. The method of claim 5 in which the step of moving an anvil assembly into a position to act as a fulcrum includes:

pivoting an anvil assembly to a lowered position approximately level with a portion of the workpiece to be bent; and moving a hemming machine that pivotably supports the anvil assembly to a bending position adjacent the bending machine.

8. The method of claim 7 in which the step of forming a hemmed part includes:

retracting the hemming machine and anvil assembly from engagement with the panel;

pivoting the anvil assembly to a raised position; and advancing the hemming machine into a hemming position adjacent the panel.

9. The method of claim 8 including the additional step of further bending the workpiece by actuating the bending machine to rotate the movable die portion of the bending machine to a closed position after the step of pivoting the anvil assembly to a raised position and before the step of actuating the hemming machine to hem the workpiece.

10. The method of claim 5 in which the step of forming a finished part from the workpiece includes actuating the hemming machine to hem together mating edges of the workpiece.

* * * * *